US005388733A

United States Patent [19]

Richard

[11] Patent Number: 5,388,733

[45] Date of Patent: Feb. 14, 1995

[54] SLIDE GATE VALVE HAVING REPLACEABLE REFRACTORY VALVE PLATE ASSEMBLY AND METHOD OF REPLACING THE SAME

[75] Inventor: Francois N. Richard, Nancy, France

[73] Assignee: Vesuvius France, Feignies, France

[21] Appl. No.: 214,287

[22] Filed: Mar. 17, 1994

[30] Foreign Application Priority Data

Apr. 19, 1993 [EP] European Pat. Off. ..... 93401009

[51] Int. Cl.[6] ..... B22D 41/38; B22D 41/22

[52] U.S. Cl. ..... 222/600; 222/590

[58] Field of Search ..... 266/236, 45; 222/590, 222/600

[56] References Cited

U.S. PATENT DOCUMENTS

| | | | |
|---|---|---|---|
| 4,623,130 | 11/1986 | Bruckner et al. | 222/600 |
| 4,660,749 | 4/1987 | Yokoi et al. | 222/600 |
| 4,728,014 | 3/1988 | Keller | 222/600 |
| 4,892,235 | 1/1990 | King | 222/600 |
| 5,011,050 | 4/1991 | Verel | 222/600 |
| 5,211,857 | 5/1993 | Brinker | 222/600 |

OTHER PUBLICATIONS

"Interstop–Konferenz in der Bundesrepublik Deutschland" 17 Jan. 1974, Stahl Und Eisen 94 (1974) No. 2, Dusseldorf, pp. 70–72.

"Schieberverschlusse fur Stahligiesspfannen und Zwischenpfannen" 9 Dec. 1971, Stahl Und Eisen 91 (1971) No. 25, Dusseldorf, p. 1451.

*Primary Examiner*—Scott Kastler

*Attorney, Agent, or Firm*—Sixbey, Friedman, Leedom & Ferguson

[57] ABSTRACT

A slide gate valve having a replaceable refractory valve plate assembly is provided for facilitating maintenance operations. The slide gate valve generally comprises a metallic frame mounted on a metallurgical vessel, at least one fixed refractory plate having one flow opening, at least one moveable refractory plate having a flow opening, a pouring nozzle firmly connected to the moveable plate, a pneumatic cylinder for controlling the displacement of the moveable plate with respect to the fixed plate in order to control the overlap of the flow openings of the two plates, and an interconnection structure for unitizing the fixed and moveable refractory plates and the pouring nozzle into a valve plate assembly that is installable in and removable from the metallic frame of the slide gate valve in a single operation. The refractory plates may each be covered by metallic shells and the interconnecting structure may take the form of slidably interfitting rails and recesses between the two metallic shells which unitize the refractory plates during a replacement operation, but which allow the pneumatic cylinder to displace the fixed and moveable plates during the operation of the slide gate valves.

16 Claims, 5 Drawing Sheets

SLIDE GATE VALVE HAVING REPLACEABLE REFRACTORY VALVE PLATE ASSEMBLY AND METHOD OF REPLACING THE SAME

BACKGROUND OF THE INVENTION

This invention generally relates to slide gate valves for regulating a flow of molten metal, and is specifically concerned with a replaceable refractory valve plate assembly for facilitating maintenance operations for gate valves of the type comprising: a metallic frame mounted on a metallurgical vessel, such as a steel convertor, at least one fixed refractory plate having at least one flow opening, at least one movable refractory plate having at least one flow opening, at least one pouring nozzle firmly connected to the movable plate, means for controlling the displacement of the movable plates with respect to the fixed plate in order to control the overlap of the flow openings of the two plates; and compression means for forcefully engaging the movable plate against the fixed plate to provide a fluid seal therebetween.

In a device of this type the metal parts of the slide gate valve, particular the metal frame or housing, generally have a service life of several hundred or even several thousand tappings of the molten metal. By contrast, the flow-regulating refractory components (i.e., the fixed plate, the movable plate, and pouring nozzle) have a service life of only a small number of tappings, and thus must be replaced frequently.

Two methods are currently employed to replace these refractory components:

According to a first method, each refractory component is replaced individually. In certain configurations the pouring nozzle is accessed from outside the metal frame, but it is necessary to open the frame in order to gain access to the refractory plates. For example, the slide gate valve may have a door or the like mounted on hinges, which door can be opened to gain access to the refractory components. Each worn refractory plate is removed individually and replaced by a new refractory plate, which may or may not be covered with a metal shell. This method is satisfactory when the refractory components to be manipulated are light enough to be replaced manually and are accessible under environmental conditions which allow the operator to have easy access without danger. However, in the case of large slide gate valves, such as those used for steel furnaces, converters, or large ladles or tundishes, each refractory component may weigh hundreds of pounds. In the case of furnaces or converters (which, in contrast to ladles, tundishes and the like, cannot be transported away from their operating environment), the refractory components must be replaced in situ under conditions which themselves impose a stress on an operator, particularly with regard to heat. These conditions are aggravated in that the slide gate valve cannot be adequately cooled due to the constraint of keeping plate replacement time to a minimum, since production must be interrupted during this time and thus losses must be suffered. The conditions imposed on the operator are thus particularly arduous. It is conceivable to aid the operator with implements such as robots or manipulators. For such implements, the weight of the plates is not an obstacle. However, a crucial factor lies in the number of operations to be carried out. The time required to replace the plates with the aid of a manipulator or robot will be much greater than that required for an operator to perform the same replacement manually.

Each gripping implement must be adapted to the object to be manipulated. A solution of this nature will thus be very costly, complex and time-consuming.

According to a second known method, the entire slide gate valve is removed from the vessel and replaced by a new slide gate valve containing new refractory components. This method also has a number of drawbacks. The complete slide gate valve weights much more than the refractory components to be replaced, e.g. 20 times more. Thus, if the refractory components weight 100 kg, it is necessary to manipulate other components weighing 2000 kg, which requires powerful implements and very long manipulation times. Under the second method, it is also necessary to disconnect and reconnect the pneumatic cylinder or the like which slides the movable plate back and forth, and to remove and reattach various protective shields that surround the valve. The total time required and the number of operations required are considerable. Moreover, the slide gate valve containing the worn refractory components must be transported to a shop where the worn refractory components are replaced by new ones. While the working conditions are less stressful, particularly as regards to heat, and the time factor is less critical because production need not be interrupted during this refitting the number of operations necessary to replace the refractory elements remains the same, and the cost of the transportation means and the shop must be borne.

SUMMARY OF THE INVENTION

Generally speaking, the present invention comprises a replaceable assembly of the flow-regulating refractory components of a slide gate valve which must be periodically changed which remedies the drawbacks of the two previously-described methods. The invention further comprises a method of replacing the assembly of flow-regulating refractory components.

In the assembly of flow-regulating refractory components according to the invention, the pouring nozzle is firmly connected to the movable plate, and the fixed refractory plate and the movable refractory plate are interconnected in such a way as to constitute a single structure which can be inserted in and/or removed from the slide gate valve in a single operation.

The inventive method is applicable to a slide gate valve of the type comprising a metallic frame or housing mounted on a metallurgical vessel, at least one fixed refractory plate having at least one opening, at least one movable refractory plate having at least one opening, means for controlling the displacement of the movable plate with respect to the fixed plate in order to control the overlap of the flow opening of the fixed plate relative to the flow opening of the movable plate, and compression means for forcefully engaging the movable plate against the fixed plate to form a seal, and generally comprises the step of installing, replacing or removing all of the flow-regulating refractory components in a single operation.

In a first step of the inventive method, the used flow regulating refractory components are removed in a single operation, and in a second step, a new set of flow regulating refractory components are installed. Accordingly, only a single gripping device and a single movement are sufficient, whereas in the prior art each refractory component required a specific gripping element and a specific movement. The time of manipulation is substantially reduced due to the fact that individual manipulation of each one of the components is replaced by a single overall manipulation. The reduction of the number of movements facilitates automation; the number of necessary manipulations is reduced by a factor of 2–3.

Because the necessary amount of manipulation is simpler and therefore faster, it is possible to carry it out in situ, without resorting to the second prior art method previously described wherein the entire slide gate valve was removed to be disassembled in a special shop. Consequently, the advantages of the first described method are preserved. The weights of the parts to be manipulated are limited to the weights of the flow-regulating refractory plates, possibly with the addition of the weights of the metal shells directly attached to the plates. This is advantageous because one need not employ manipulating implements capable of handling very heavy loads, such as the metal frame that secures the refractory components.

Other characteristics and advantages of the invention will be apparent from the following description and the descriptions of exemplary embodiments which follow thereafter, which description and examples are offered for illustrative purposes and do not limit the scope of the invention, and are presented with reference to the accompanying drawings.

DETAILED DESCRIPTION OF THE PREFERRED EMBODIMENT

Figure 1:
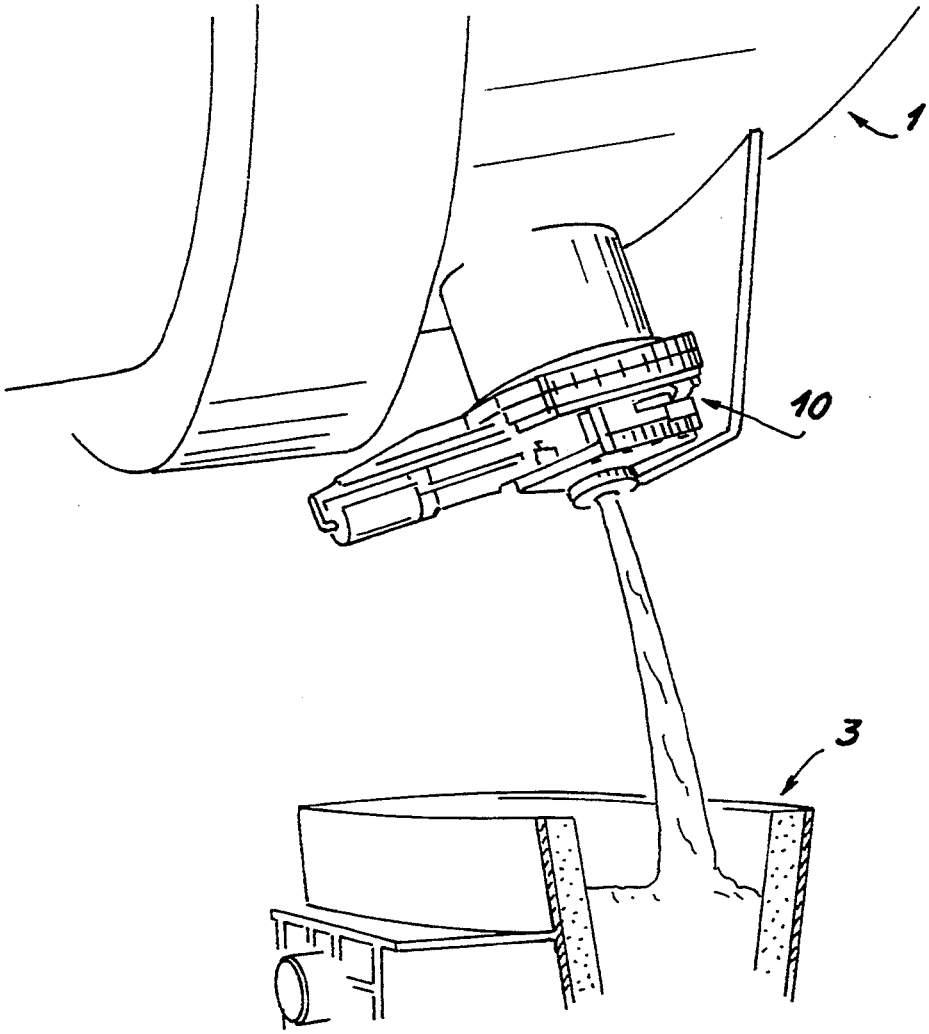
FIG. 1 is an overall view of a converter for holding molten metal and a slide gate valve mounted on the converter.

FIG. 1 is an overall view of part of a steelmaking converter 1. A slide gate valve 10 is affixed to the converter 1. The molten steel contained in the converter is being transferred into a ladle 3 via a taphole in the converter 1 controlled by the valve 10.

Figure 2:
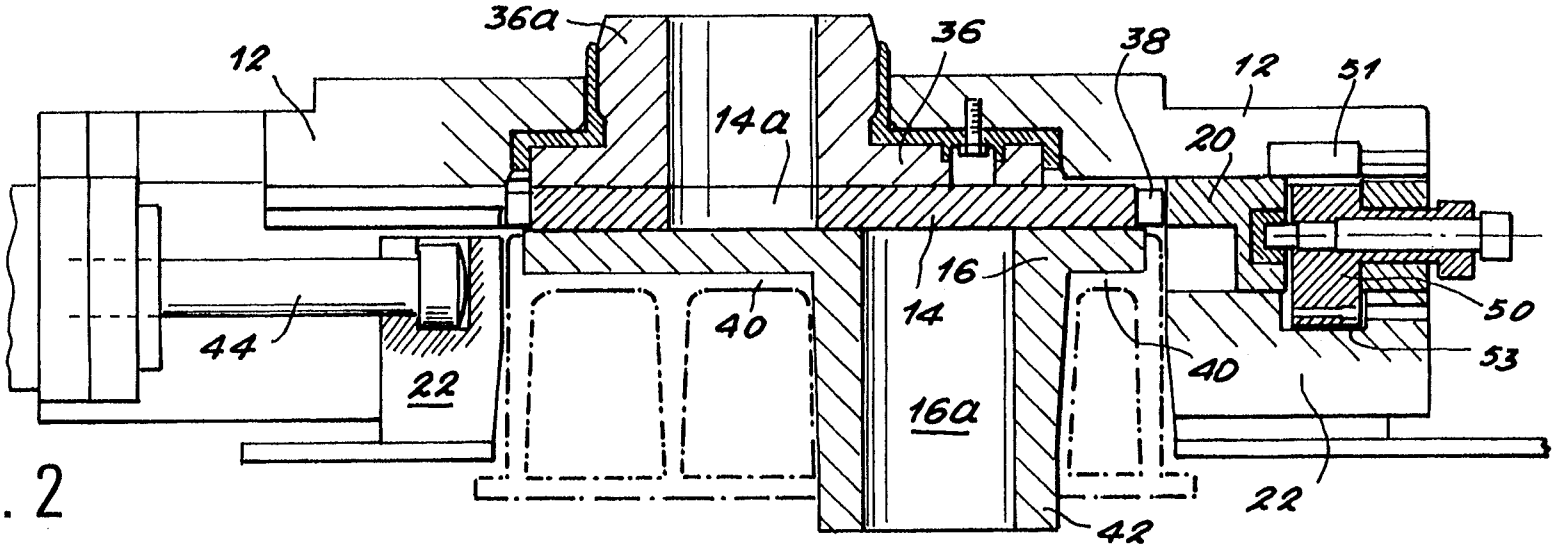
FIG. 2 is an overall longitudinal cross section of a slide gate valve of the type shown in FIG. 1.

FIG. 2 is a cross section of the slide gate valve 10 mounted on the converter 1. The valve is comprised of a metallic frame 12 affixed to the exterior wall of the converter 1 and accommodating an assembly of two plates, i.e., a fixed plate 14 and a movable plate 16, each having a valve opening (14*a*, 16*a*, respectively) for the passage of the molten metal. A compression means forcefully engages the movable plate 16 against the fixed plate 14, and the fixed plate 14 against a plate 36 mounted in an opening in the frame 12. The compression means 26 will be described in detail hereinafter with reference to FIG. 3.

The fixed plate 14 is disposed in a carrying frame 20. The movable plate 16 is disposed in a different carrying frame 22. A compressed air cylinder or the like (hereinafter "air cylinder") is provided, the plunger 44 of which is held in a receptacle in the carrying frame 22 of the movable plate. The air cylinder enables displacing the movable plate 16 over the fixed plate 14.

This relative displacement allows one, in known fashion, to vary the overlap of the flow openings 14*a*, 16 of the two plates so as to control or completely arrest the flow of the molten metal. It is noted that in the example shown the flow regulating components of the slide gate valve are comprised of all three plates, namely the connecting plate 36, the fixed plate 14, and the movable plate 16. However, the fixed plate 14 and movable plate 16 are the only operating plates which are subjected to major erosion from contact with the molten metal. The connecting plate 36 is not subjected to the erosive action of the molten metal to the same degree, and is only replaced when the converter is empty. In the example shown, the flow regulating components comprise just two operating plates in addition to the connecting plate; however, it may comprise three or more operating plates, depending on the particular design of the slide gate valve.

The term "valve plate assembly" indicates, in the example shown, the fixed plate 14, possibly surrounded by a metallic shell 38 and the movable plate 16 associated with the pouring nozzle 42, wherewith the plate 16 and nozzle 42 are likewise mounted in a metal shell 40. However, the valve plate assembly does not include the connecting plate 36 attached to the internal nozzle 36*a*. The shell 40 holds together the movable plate 16 and the nozzle 42. It provides the assembly with sufficient rigidity to serve as a surface of support of the compression means 26 which will be described hereinafter. It also bears a shield 40*a* which protects against heat radiation and molten metal splashes.

Figure 3:
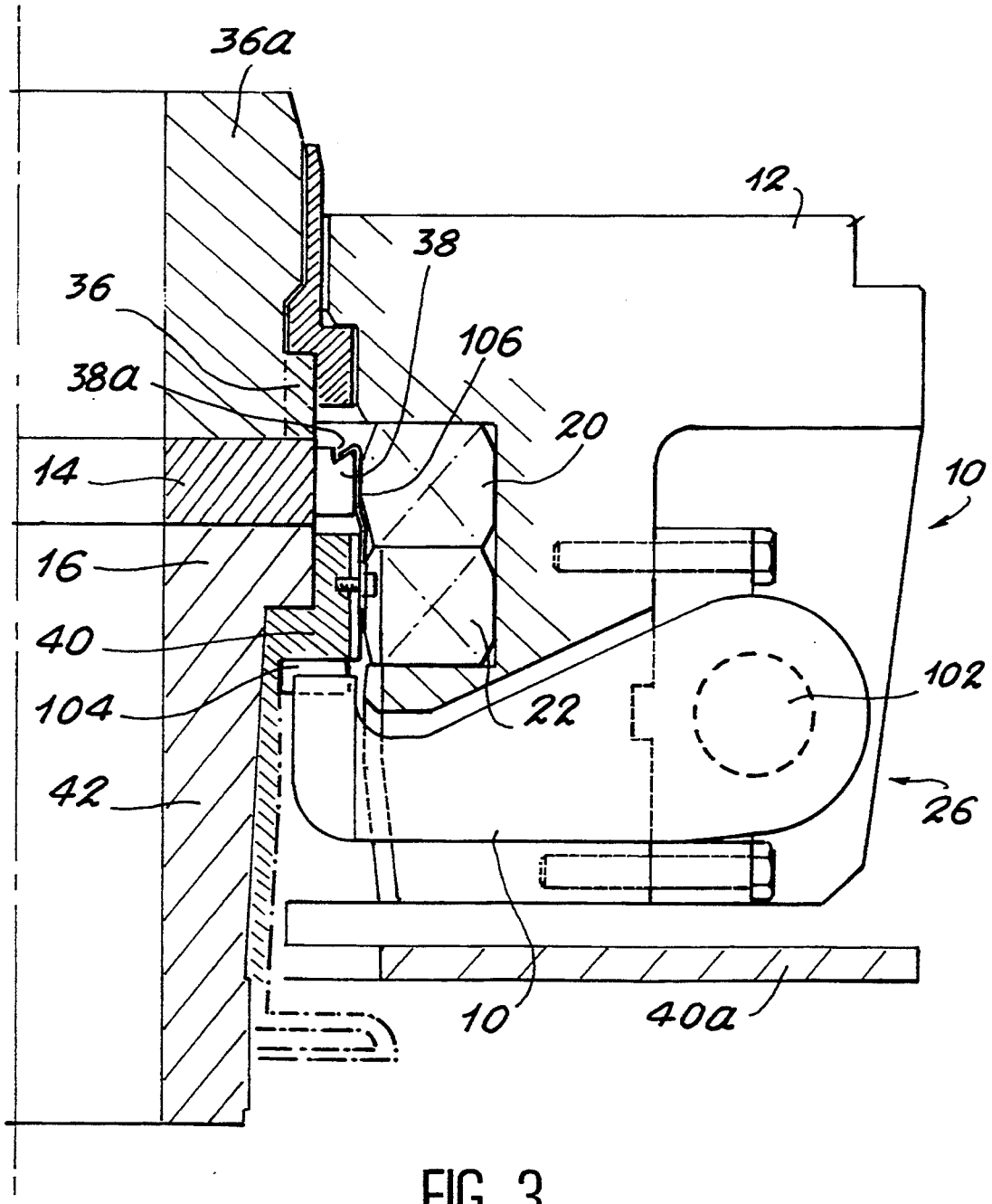
FIG. 3 is a cross section in a plane perpendicular to that of FIG. 2 showing the details of the means of connecting the fixed refractory plate and the movable refractory plate of the valve.

The weight of the valve plate assembly is reduced to the minimum compatible with flow regulating functions. FIG. 3 shows a cross section, in a perpendicular plane, of the embodiment of FIG. 2. This figure shows the detail of the compression means, designated generally 26. Said means comprise a lever 10 at one end of which a torsion bar 102 is fixed (shown in transverse cross section). The other end of the lever 10 is applied against a sliding contact member 104, which is fixed to the metal shell 40. The force of the lever is transmitted to the plate 16 and then to the plate 14 which is supported against the connecting plate 36. A static seal is thereby provided between the fixed plate 14 and the connecting plate 36, and a dynamic seal between plates 14 and 16. It is noted that the compressive means 26 for holding the fixed plate against the connecting surface of the discharge tap opening are the same as the means for pressing the fixed plate 14 against the movable plate 16. Thus the same means performs two distinct functions.

According to the invention, the metal shell 38 surrounding the fixed plate 14 has a recess 38*a*. A tongue member 106 is affixed to the metal shell 40 which surrounds the movable plate 16 and the collecting nozzle 42. This tongue member 106 engages the recess 38*a*. The tongue member 106 and the recess 38*a* constitute the means enabling the refractory elements to be connected to form an assembly which can be inserted into and removed from the closure 10 as a single assembly and thus in a single operation. More precisely, in the example illustrated, the assembly comprises not only the fixed and movable plates themselves but also the shells 38 and 40 and the nozzle 42. It is this assembly which is inserted and/or removed in a single operation. Granted, the weight which must be handled is greater than that of the refractory plates themselves; however, the increase in weight is moderate.

The holding means (FIG. 2) for holding the carrying frame 20 of the fixed plate both with respect to the housing 12 and with respect to the carrying frame 22 of the movable plate will now be described in detail. These means are comprised of a two-position lock 50, mounted on the carrying frame 20 of the fixed plate. In the first position, shown in FIG. 1, the locking member of the lock extends into a recess 51 in the housing 12. In the second position, the locking member extends into a recess 53 provided in the carrying frame 22 of the movable plate 16. In the first position it immobilizes the carrying frame 20 of the fixed plate 14 with respect to the housing, and in the second position it immobilizes the frame 20 with respect to the carrying frame 22 of the movable plate 16. The plunger 44 of the cylinder has a sufficient range to displace the assembly of the two frames 20, 22 to remove the set of refractory components from the region of influence of the means of compression of the fixed plate 14 against the connecting surface of the discharge tap opening. The two-position lock 50 enables the air cylinder to perform two distinct functions. First, it displaces the movable plate 16 over the fixed plate 14. Secondly, during removal of the components to be replaced, it serves to insert a new fixed plate (which looks exactly like pate 14). For this latter purpose, the lock 50 is put into its second position, which enables one to displace only one block among the carrying frame 20 of the fixed plate 14 and the carrying frame 22 of the movable plate 16, which frames are held together by the lock 50. The set of refractory components to be replaced is displaced at the same time as the frames (20, 22).

Figure 4:
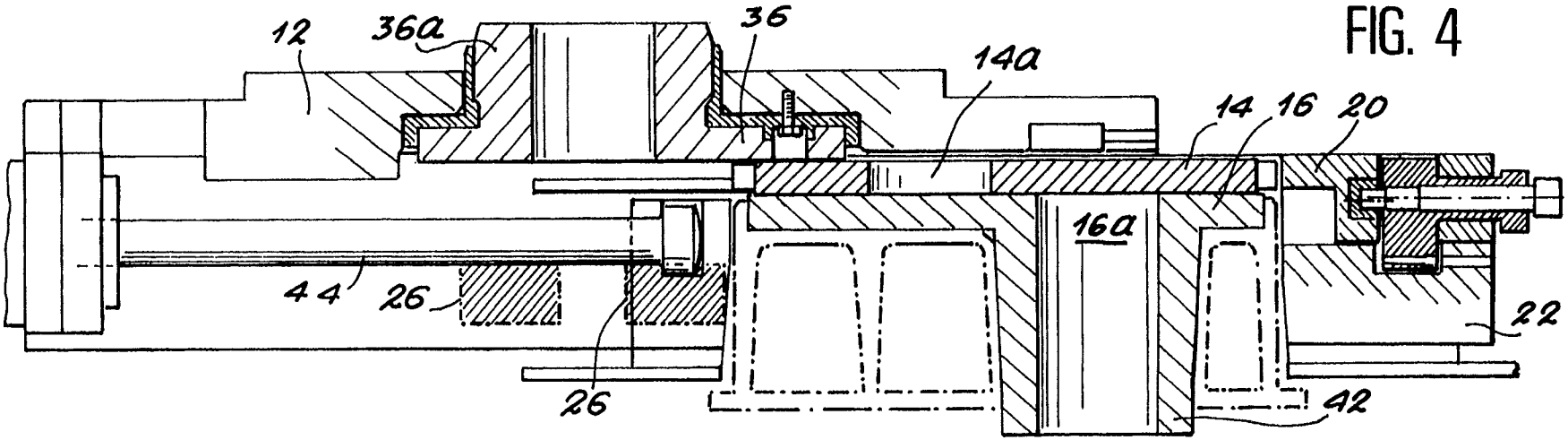
FIG. 4 is a view of the slide gate valve of FIGS. 2 and 3, in another position.

FIG. 4 shows the slide arrangement of FIG. 3 in an open position (i.e. preparatory to replacement of parts). It may be noted that the lock 50 is disposed in the above-mentioned second position in which it firmly connects the carrying frame 20 of the fixed plate 14 to the carrying frame 22 of the movable plate 16. The plunger 44 of the air cylinder that is connected to the carrying frame 22 of the movable plate 16 is used to push the assembly comprised of the two frames 20, 22 along with the plates 14, 16 disposed in the recesses of these frames. The extent of this movement is sufficient to completely remove the described set of refractory components from the action of the compression means 26. Since the recesses in frames 20 and 22 are superimposed, the set of refractory components can be easily removed without having to open a door or the like such as is generally required in devices according to the prior art. It is not necessary to make or break any connection, because the plunger 44 of the air cylinder remains affixed during its operation to the carrying frame 20 of the fixed plate 14. The assembly to be replaced, which as stated is comprised of the fixed refractory plate 14, the movable refractory plate 16, the shell 38 of the fixed plate 14, and the shell 40 of the movable plate 16, is removed in a single operation using a gripping device. A replacement assembly comprising new refractory components is then inserted by means of the same or a different gripping device.

The air cylinder is then actuated to draw in the new assembly, which moves laterally inward with respect to the discharge tap opening under the compression means 26; in this way the two new plates 14, 16 are positioned without any supplementary operation. The new fixed plate 14 is slid under the compression means 26 before the flow opening 14*a* in new plate 14 begins to overlap the discharge tap opening in the connecting plate 36.

It is seen that this embodiment has a dual advantage. First, according to the invention it enables the set of refractory components 14, 16 to be changed in a single operation without having to handle individual refractory plates separately in succession. This is important when the set of refractory elements comprises two plates as in the example illustrated. Appreciable time is saved; and even more time is saved if two gripping devices are employed, one to remove the used refractory plates 14, 16 and the second to insert a new set of refractory plates. The two gripping devices do not perform the identical function, because it is easier to remove the set of used refractory plates 14, 16 than to insert a new set. Accordingly, the gripping device which performs removal does not need to be very sophisticated. The use of two gripping devices enables the second of these devices, the one which inserts the new set of refractory elements, to be held in readiness. It may go into action as soon as the used refractory plates 14, 16 have been removed. This gains precious time, particularly in the case of a converter for which it is desirable that the time to replace refractory components be kept to less than few or several minutes.

The illustrated embodiment affords a second advantage. In the slide gate valves according to the prior art, access to the refractory components to be replaced is by means of a door or the like which is pivotally mounted on hinges. The door must be opened in order to gain access to the refractory components. Then after replacing the refractory components one must reclose the door before one can return the closure to operation. These two supplementary steps consume time, and moreover are not readily automated.

It is seen that according to the embodiment illustrated it is unnecessary to open and close a door in order to access the refractory components. The refractory components are removed and the new components are inserted by sliding the assembly being replaced (i.e., sliding out the old and sliding in the new assemblies). This eliminates the need for the door opening and closing steps. Further, the operation is easily accomplished because no manual intervention is required, only the simple action of an air cylinder. Note that the air cylinder employed is the same one as used in known fashion to move the valve plates and control the flow. Thus no added material or apparatus is required.

Figure 5:
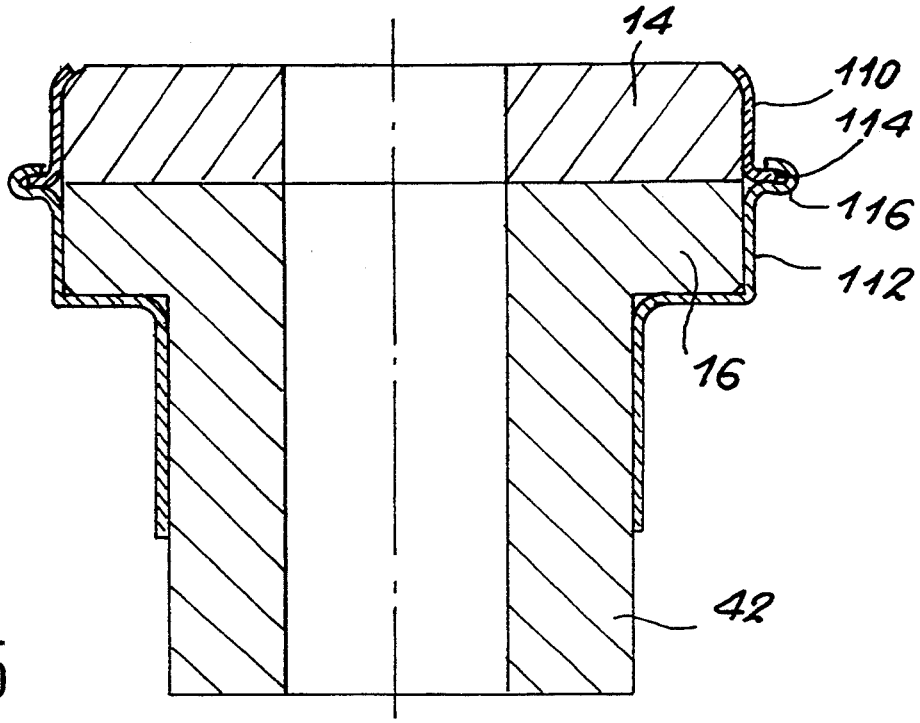
FIG. 5 is a schematic view of an alternative embodiment in which the means of connection of the refractory valve plates are disposed on the metal shells of the refractory plates.

FIG. 5 shows a variant embodiment of the invention. Here the fixed refractory plate 14 is surrounded by a metal shell 110, which is comprised of, e.g., steel sheet or plate material. The movable refractory plate 16 is also surrounded by a metal shell 112. In the example shown, a nozzle 42 is rigidly affixed to said movable refractory plate. The shell of the fixed refractory plate is bent to form a flange 114. The metal shell 112 of the movable refractory plate is bent around and above the flange 114 of the metal shell 110 of the fixed refractory plate, so as to form a guideway 116 for sliding movement. This guideway and flange comprise the connection which enables the fixed and movable refractory plates 14, 16 to be inserted or removed in a single operation with respect to the slide gate valve. Obviously, if the assembly of refractory valve plates comprises more than two such plates, each refractory plate may have a respective metal shell and may be slidably connected to and against the neighboring refractory plates by means of a guideway or guideways analogous to that just described. With such an arrangement it is still possible to separate the two plates by vertical manipulation after they have been slid horizontally so that their respective flanges and guideways no longer engage. This drawback is overcome according to the invention by equipping the guideways with terminal detents to limit the extent of the sliding movement. In any event, a sufficient sliding extent should be allowed to enable normal operation of the slide gate valve when the plates are installed.

Figure 6:
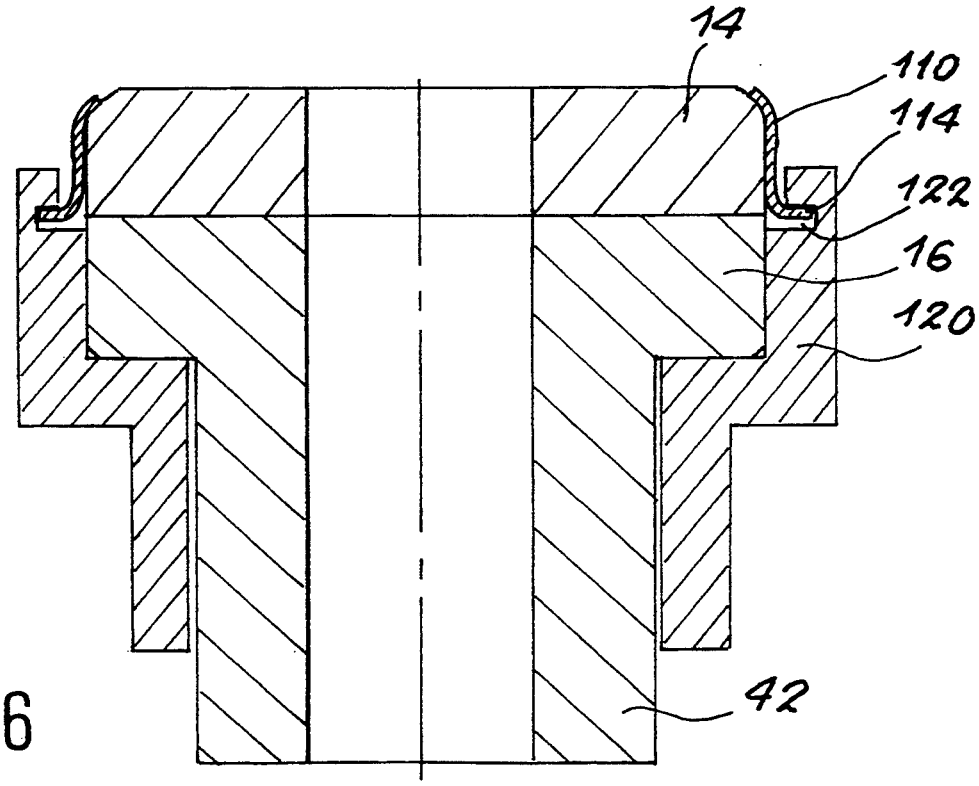
FIG. 6 is another embodiment in which the means of connection are disposed on the metal shell of the fixed plate and on a frame in which the movable plate is disposed.

FIG. 6 shows another variant embodiment of the device shown in FIG. 5. Here the fixed refractory plate 14 has a metal shell 110 identical to that described in connection with FIG. 5, but the movable refractory plate 16 and the discharge tap nozzle 42 are disposed in a rigid metal frame 120 having a groove 122 which engages the flange 114 of the metal shell 110 of the fixed refractory plate 14 to provide a guideway for sliding, as described above. This guideway may also be equipped with motion-limiting detents.

When a new set of refractory components is installed, it is necessary to hold the fixed plate 14 in a precise predetermined position with respect to the moveable plate 16. According to the invention this is readily achieved by adhesively bonding the two plates together, wherewith the adhesive bond is broken by the means employed to move the fixed plate 14 at the time of the first operation of the slide gate valve. The predetermined relative fixing may also be achieved by providing mechanical alignment means sufficiently strong to maintain the relative position of the two plates during the manipulation step of the installation but sufficiently weak to be overcome by the means employed to move the movable plate 16; such alignment means may be, e.g., a set screw or wedge, a pin extending between the metal frames, or other suitable means.

Figure 7:
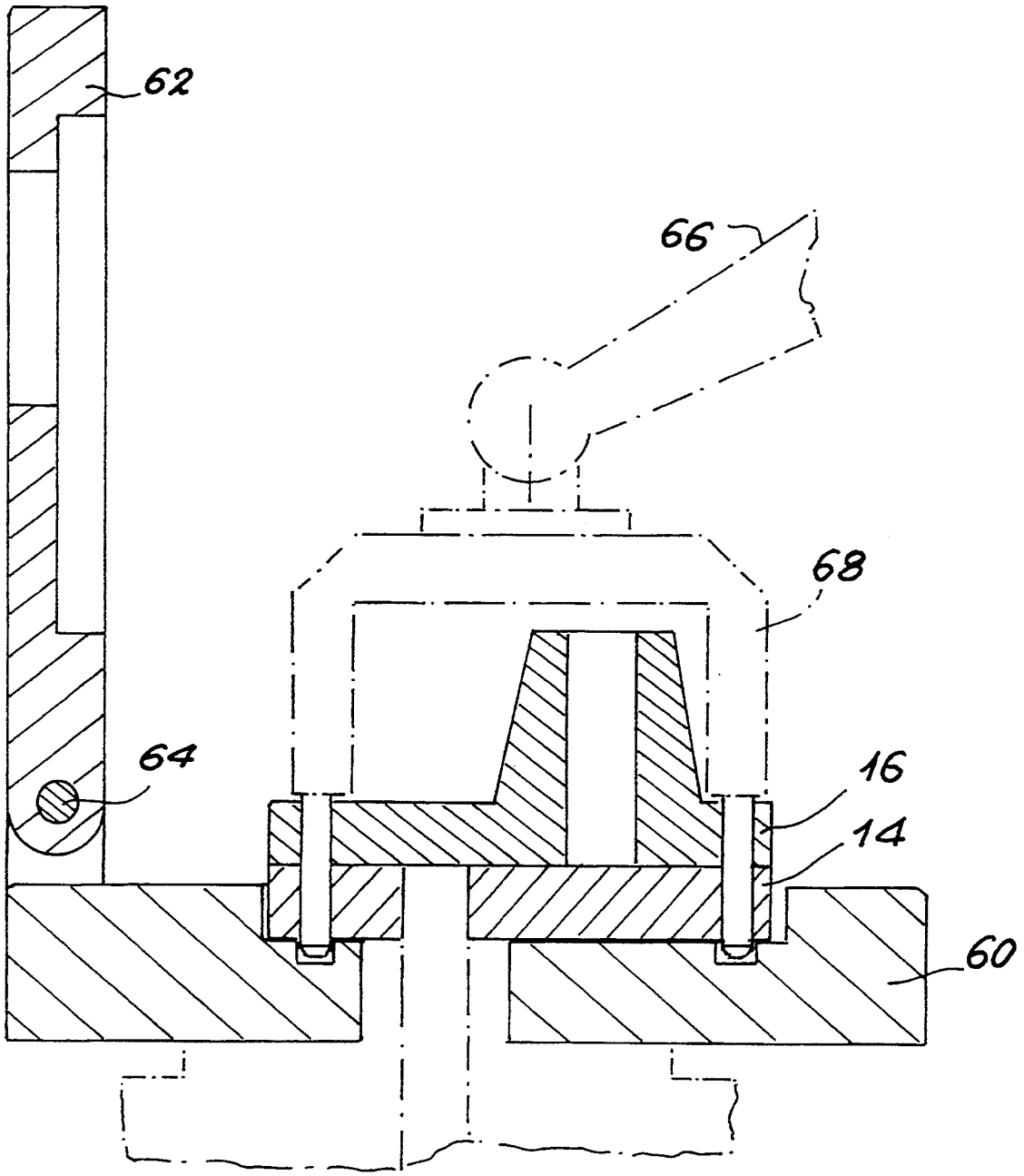
FIG. 7 is a view of a gripping device intended to be used in a variant of the inventive method.

FIG. 7 shows another variant embodiment of the invention, according to which a fixed housing 60 has a doorlike device 62 mounted on hinges 64 mounted on the fixing housing 60. The set of refractory components to be replaced is comprised of a fixed refractory plate 14 and a movable refractory plate 16. These plates have throughgoing holes which are mutually aligned. A manipulator 66 is comprised of a gripping member 68 the end of which can be introduced into the said holes. The gripper 68 comprises means which can connect the plates 14, 16 constituting the subject set, whereby the set can be inserted or removed in a single operation. It is seen that in this exemplary embodiment that the means which enable the plates to be interconnected are exterior to the set of refractory components. Such suffices because it is only necessary that the plates be interconnected during the time that they are being manipulated (i.e., inserted or removed).

I claim:

1. A slide gate valve for controlling a flow of molten metal from a metallurgical vessel, comprising at least one fixed refractory plate having at least one flow opening for conducting a flow of molten metal;

at least one movable refractory plate having at least one flow opening;

a metallic frame mounted on said metallurgical vessel for supporting said fixed and movable refractory plates with respect to said vessel;

at least one pouring nozzle for directing said flow of molten metal from said flow openings;

means for displacing the movable plate with respect to the fixed plate in order to control an overlap between the openings of the fixed and movable plate to regulate said flow of molten metal;

means for compressing the movable plate against the fixed plate to form a seal therebetween, and means for interconnecting said fixed and said moveable refractory plates and said pouring nozzle into a valve plate assembly that is installable in and removable from said metallic frame of said slide gate valve in a single operation, wherein said interconnecting means is mechanically independent from said metallic frame.

2. A slide gate valve according to claim 1, wherein said interconnecting means includes means for slidably interconnecting said fixed refractory plate with respect to said movable refractory plate and said pouring nozzle, the extent of slidable movement afforded by said slidable interconnecting means being sufficient for regulating a flow of molten metal through said slide gate valve.

3. A slide gate valve according to claim 1 wherein said fixed refractory plate, said movable refractory plate and said pouring nozzle are covered by metal shells, and said-interconnection means includes an interconnection between said shells.

4. A slide gate valve according to claim 3, wherein the interconnection means of the plates and nozzle includes a sliding mechanism affixed to said metal shells for affording sliding movement between said plates.

5. A slide gate according to claim 2, wherein said interconnecting means further includes a lock means for preventing movement of said fixed refractory plate relative to said moveable refractory plate during an installation or removal operation, but for allowing relative movement after an installation or removal operation.

6. A slide gate according to claim 5, wherein said lock means includes a frangible means disposed between said fixed refractory plate and said movable refractory plate, said frangible means being breakable by said displacing means when said displacing means initially moves said movable plate after said installation operation.

7. A slide gate valve according to claim 1 further comprising means for securing said refractory plates in a superposed position with respect to each other, said means being mechanically independent from said slide gate valve.

8. A slide gate valve according to claim 7, wherein said securing means further comprises a gripping and manipulating means capable of holding and locking the refractory plates in a selected relative position.

9. A method of replacing a refractory valve plate assembly of a slide gate valve that includes a metallic frame mounted on a metallurgical vessel; at least one fixed refractory plate supported by said frame and having at least one flow opening; at least one movable refractory plate supported by said frame and having at least one flow opening; at least one pouring nozzle for directing a flow of molten metal into said flow opening; means for displacing the movable plate with respect to the fixed plate in order to control the overlap of the flow openings of the plates to control said flow of molten metal; means for compressing the movable plate against the fixed plate to form a seal; comprising the steps of interconnecting said fixed and movable refractory plates into a valve plate assembly with an interconnecting means that is mechanically independent of said metallic frame, and removing and installing said valve plate assembly with respect to the frame of the slide gate valve in a single operation.

10. A replacement method according to claim 9, wherein a holding implement is employed which comprises a gripping device that interconnects said fixed and movable refractory plates during installation, emplacement, de-emplacement, and removal of said plates.

11. A replacement method according to claim 9, wherein one manipulating implement is employed to remove a used valve plate assembly and another manipulating implement is employed to install a new valve plate assembly so as to reduce the time required to replace the fixed and movable plates of the assembly.

12. A replacement method according to claim 9, wherein a fixed and a movable refractory plate of a used valve plate assembly are removed primarily by gravity from said metallic frame and a new valve plate assembly is installed wherein the plates of said new assembly are interconnected only during said installation.

13. A replacement method according to claim 9, wherein metal shells surround said fixed and movable refractory plates, and wherein said shells are replaced at the same time as said refractory plates.

14. A method of replacing fixed and movable refractory valve plates mounted in a frame of a slide gate valve of the type wherein a displacement means is used to displace the movable plate with respect to the fixed plate to control a flow of molten metal, and a compression means is used to apply a compression force of the two plates to create a dynamic seal between the two plates, comprising the steps of:

using the displacement means to displace both the fixed and movable refractory plates into a position outside of said compressive force applied by the compression means to free said plates from the slide gate valve, and manipulating the free plates out of the frame of the said slide gate valve without opening said frame, wherein the fixed and movable plate are each surrounded by different carrying frames, each of which is mechanically independent of the slide gate frame, and wherein the two carrying frames are firmly interconnected by a lock means having two positions, which lock means are mounted on the carrying frame of the fixed plate.

15. A replacement method according to claim 14, wherein the carrying frame of the fixed plate has a central recess into which the fixed plate is inserted, and the carrying frame of the movable plate has a central recess into which the movable plate is inserted, wherein the two central recesses of the two frames are superposed during the removal of the refractory plates.

16. A slide gate valve for controlling a flow of molten metal comprising:

a metallic frame mounted on a metallurgical vessel;

at least one fixed refractory plate having at least one flow opening for conducting a flow of molten metal;

at least one movable refractory plate having at least one flow opening;

at least one pouring nozzle for directing said flow of molten metal from said flow openings;

means for displacing the movable plate with respect to the fixed plate in order to control an overlap between the openings of the fixed and movable plate to regulate said flow of molten metal;

means for compressing the movable plate against the fixed plate to form a seal therebetween, and means for interconnecting said fixed and said moveable refractory plates and said pouring nozzle into a valve plate assembly that is installable in and removable from said metallic frame of said slide gate valve in a single operation, wherein said interconnecting means includes (1) means for slidably interconnecting said fixed refractory plate with respect to said movable refractory plate and said pouring nozzle, the extent of slidable movement afforded by said slidable interconnecting means being sufficient for regulating a flow of molten metal through said slide gate valve, and (2) a lock means for preventing movement of said fixed refractory plate relative to said moveable refractory plate during an installation or removal operation, but for allowing relative movement after an installation or removal operation.

* * * * *